US006420952B1

(12) United States Patent
Redilla

(10) Patent No.: US 6,420,952 B1
(45) Date of Patent: Jul. 16, 2002

(54) FARADAY SHIELD AND METHOD

(75) Inventor: Jack A. Redilla, Sheffield Lake, OH (US)

(73) Assignee: Core Technology Inc., Avon, OH (US)

( * ) Notice: Subject to any disclaimer, the term of this patent is extended or adjusted under 35 U.S.C. 154(b) by 0 days.

(21) Appl. No.: 09/408,588

(22) Filed: Sep. 29, 1999

Related U.S. Application Data

(60) Provisional application No. 60/102,414, filed on Sep. 30, 1998.

(51) Int. Cl.[7] ..... H01F 5/00

(52) U.S. Cl. ..... 336/84 M; 336/84 C; 336/84 R; 336/200

(58) Field of Search ..... 336/84 R, 84 C, 336/84 M, 200

(56) References Cited

U.S. PATENT DOCUMENTS

| | | | | | |
|---|---|---|---|---|---|
| 4,518,941 | A | * | 5/1985 | Harada | 336/69 |
| 4,868,265 | A | * | 9/1989 | Gupta | 528/26 |
| 4,945,356 | A | * | 7/1990 | Henderson et al. | 340/941 |
| 5,319,342 | A | * | 6/1994 | Kuroki | 336/170 |
| 5,430,424 | A | | 7/1995 | Sato et al. | |
| 5,801,521 | A | | 9/1998 | Mizoguchi et al. | |

* cited by examiner

*Primary Examiner*—Anh Mai
(74) *Attorney, Agent, or Firm*—Renner, Otto, Boisselle & Sklar, LLP

(57) ABSTRACT

A planar transformer including a Faraday shield between primary and secondary windings. The Faraday shield is a conductive layer having low conductivity areas. The low conductivity areas may be almost any pattern. The Faraday shield and the windings of the planar transformer formed on a circuit board. A voltage source such as ground is connected to the Faraday shield.

23 Claims, 1 Drawing Sheet

FARADAY SHIELD AND METHOD

This application claims the benefit of U.S. Provisional Application No. 60/102,414, filed Sep. 30, 1998, the entire disclosure of which is incorporated by reference.

TECHNICAL FIELD OF INVENTION

This invention relates to Faraday shields, particularly to Faraday shields used in conjunction with a transformer and most particularly to Faraday shields used in conjunction with a planar transformer.

BACKGROUND OF THE INVENTION

Faraday shields have been placed between the primary and secondary windings of a transformer to reduce the electromagnetic interference or noise capacitively coupled between the windings of the transformer. The noise is often created by dv/dt signals cause by, for example, field effect transistor (FET) drain voltages or diode snaps. Transformers have included Faraday shields between the windings to reduce the noise coupled between the windings.

A typical prior art Faraday shield is a continuous solid layer of copper connected to a voltage source so as to guard against noise being coupled between the windings. The Faraday shield reduces the capacitively coupled noise by reducing the interwinding capacitance of the transformer. However, addition of the Faraday shield adds resistive losses to the transformer. The resistive losses or $I^2R$ losses result from eddy currents being induced in the Faraday shield. Until such time as a superconductor can replace the conductive materials used to make the Faraday shield, it will be impossible to eliminate resistive losses due to eddy currents.

In view of the foregoing short comings associated with previous Faraday shields, there is a strong need in the art for an improved Faraday shield having low eddy current losses while maintaining a low noise environment for the transformer.

SUMMARY OF THE INVENTION

The present invention includes a Faraday shield having low conductivity areas that reduce resistive losses associated with eddy currents while the high conductive areas of the Faraday shield guard against the occurrence of noise in a transformer. The Faraday shield of the present invention, like the Faraday shields of the prior art, reduces electromagnetic interference or noise in the transformer. Noise typically results from dv/dt signals generated by FET drain voltages and diode snaps, although noise from other sources also occurs, and is coupled between the windings by the interwinding capacitance. Faraday shields, when placed between the windings, guard against the coupling of noise between the windings. The reduction of noise results in a more ideal transformer.

However, the transformer flux is not ideally oriented and thus induces eddy currents which flow in loops in the Faraday shield. Resistive losses occur as a result of the flux because the conductive material which forms the Faraday shields is not a perfect conductor. The resistive losses make the transformer a less ideal transformer. To avoid this problem the present invention includes low conductivity areas in the Faraday shield. The low conductivity areas in the Faraday shield inhibit the looping eddy currents thereby reducing the resistive losses. Accordingly, a more ideal transformer is achieved through the use of the Faraday shield of the present invention.

To accomplish the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

The present invention will now be described more fully with reference to the accompanying drawings in which several embodiments of the invention are shown. The present invention, however, may be embodied in many different forms and should not be construed as limited to the embodiment shown. The several embodiments described are provided.

DETAILED DESCRIPTION OF THE PREFERRED EMBODIMENTS

Figure 1:
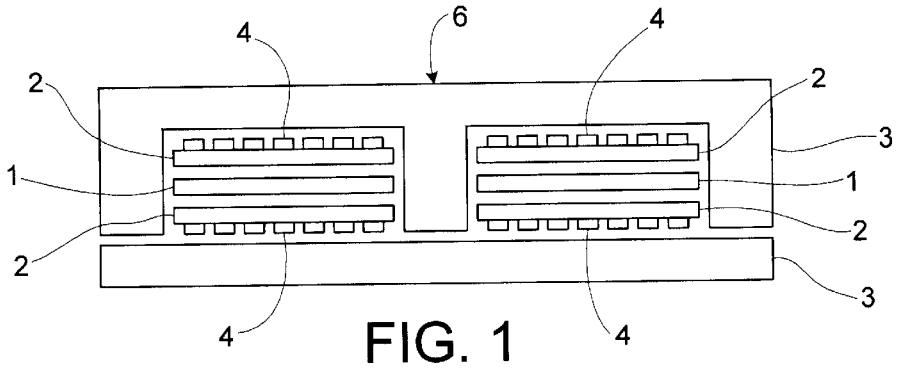
FIG. 1 is a cross-sectional view of a Faraday shield between the windings of a planar transformer.

Referring, now, in detail to the drawings, where like reference numerals designate like parts in the several figures, and initially to FIG. 1, shown is a cross-sectional view of a planar transformer 6. The transformer 6 includes a Faraday shield 1, two circuit boards 2, a core 3, a primary winding 4 and a secondary winding 5. The primary winding 4 is insulated from the secondary winding 5 and both windings 4, 5 are insulated from the Faraday shields 1 by circuit boards 2. The Faraday shield 1 is typically connected to ground, for example the ground 7 of the primary winding 4 and/or secondary winding 5, although connection to a non-zero voltage is also possible. The Faraday shield 1 is on one of the circuit boards 2 or is formed separately.

Figure 5:
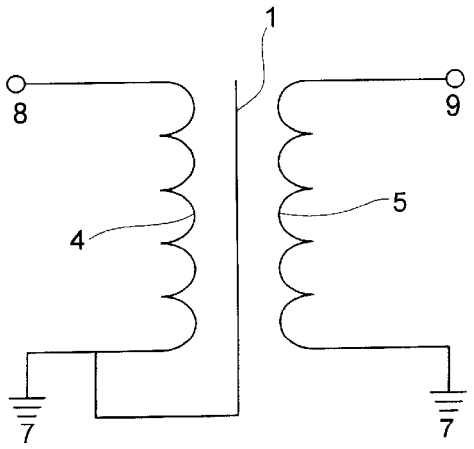
FIG. 5 is a schematic of a transformer having a Faraday shield.

FIG. 5 is the schematic of a transformer having a Faraday shield. Primary winding 4 is connected to a source 8 which causes an AC output 9 in the secondary winding 5 that is proportional to the alternating component of source 8. The Faraday shield 1 is connected to one side of the primary windings 4 and one side of the secondary windings 5, all of which is connected to ground 7. Alternatively, only one winding could be connected to the Faraday shield 1 or the Faraday shield 1 could be separately connected to ground 7. If the Faraday shield 1 is separately connected to ground 7, the windings could be connected together to ground 7 or may be separately connected to ground 7. While it is preferable that source 8 be a purely AC source, it is also possible for source 8 to include a DC offset. Lastly, while it is preferable to ground the Faraday shield 1, one side of primary windings 4, and one side of secondary windings 5, it is also possible to connect the Faraday shield 1, and/or primary windings 4 and/or secondary windings 5 to a non-zero voltage.

Figure 2:
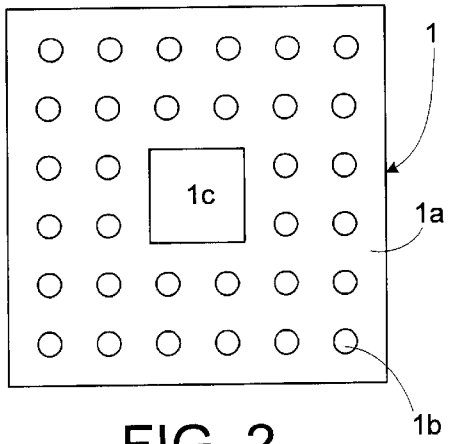
FIG. 2 is a top view of a Faraday shield of the present invention having circular low conductivity areas.
Figure 3:
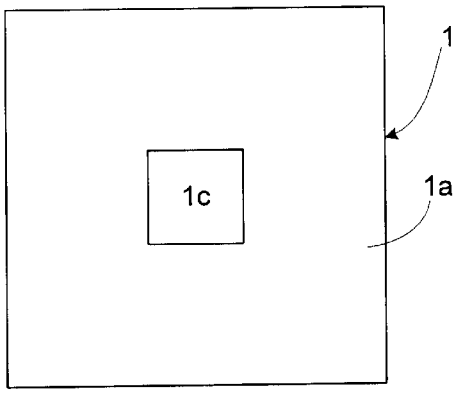
FIG. 3 PRIOR ART
FIG. 3 is a top view of a Faraday shield of the prior art.

FIG. 2 is a top view of a Faraday shield 1 of the present invention. The Faraday shield 1 is a conductive layer 1 a having low conductivity areas 1*b* throughout the conductive layer 1 and a hole 1*c* for core 3. The low conductivity areas 1*b* in conductive layer 1 a restrict or inhibit the flow of eddy currents in the Faraday shield 1 as compared to a prior art Faraday shield 1, such as shown in FIG. 3, which lacks any low conductivity areas in the conductive layer 1*a*. The inhibition of eddy currents reduces resistive losses thereby improving transformer performance.

Figure 4:
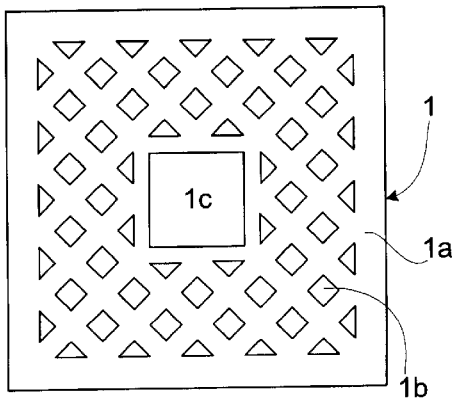
FIG. 4 is a top view of a Faraday shield of the present invention having a lattice structure.

FIG. 4 is another embodiment illustrating a top view of a Faraday shield 1 of the present invention. In this embodiment, the low conductivity areas 1 b form a lattice in the conductive layer 1*a*.

The low conductivity areas 1*b* of the Faraday shield 1 of the present invention may be almost any pattern including parallel lines, crosses, stars, and other repetitive patterns, or may be non-repetitive patterns such as random patterns. The low conductivity areas may be openings or may be a material that is either much less conductive than the conductive layer 1*a* or is an insulator. The material in the low conductivity areas may be formed by depositing the shielding layer 1 as a single material and then altering the conductivity of the material so as to increase and/or decrease the conductivity inside and/or outside the low conductivity areas 1*b*.

The conductive layer 1*a* may be any material or combination of materials provided they are conductive. For example copper, silver, gold, platinum, metallic alloys, and highly doped semiconductor materials can be used to make the conductive layer 1*a*.

The transformer 6 of FIG. 1 is intended to only be an example of one kind of transformer in which the Faraday shield of the present invention may be incorporated. The present invention may be applied to any transformer that can incorporate Faraday shields.

In the drawings and specification there has been disclosed various preferred embodiments of the invention, and although specific terms are employed they are used in a generic and descriptive sense only and not for the purpose of limitation. The scope of the claims being set forth in the following claims.

What has been described above are preferred embodiments of the present invention. It is, of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations modifications and variations that fall within the spirit and scope of the appended claims. Also, several embodiments and features are described above and are illustrated in respective drawing figures; it will be appreciated that the features described and illustrated with respect to a given embodiment may be used or incorporated in one or more other embodiments.

That which is claimed, follows:

1. A combination of a Faraday shield and windings, comprising:

a shielding layer between a first winding and a second winding, wherein the shielding layer includes a conductive material and low conductivity areas; and the low conductivity areas are generally dispersed throughout the shielding layer.

2. The combination of a Faraday shield and windings according to claim 1 wherein the conductive material forms a lattice.

3. The combination of a Faraday shield and windings according to claim 1 wherein the low conductivity areas in the shielding layer are circular.

4. The combination of a Faraday shield and windings according to claim 1 wherein the low conductivity areas in the shielding layer are openings.

5. The combination of a Faraday shield and windings according to claim 1 wherein the conductive material is a metal.

6. The combination of a Faraday shield and windings according to claim 5 wherein the metal is copper.

7. The combination of a Faraday shield and windings according to claim 1 wherein the first and second windings are part of a transformer.

8. The combination of a Faraday shield and windings according to claim 7 wherein the transformer is a planar transformer.

9. The combination of a Faraday shield and windings according to claim 1 further comprising a first circuit board and a second circuit board, wherein first windings are on the first circuit board and the second windings are on the second circuit board.

10. The combination of a Faraday shield and windings according to claim 9 wherein the Faraday shield is formed on the first circuit board.

11. The combination of a Faraday shield and windings according to claim 9 wherein the Faraday shield is formed on the second circuit board.

12. The combination of a Faraday shield and windings according to claim 1, wherein the low conductivity areas include an insulator or low conductivity material.

13. The combination of a Faraday shield and windings according to claim 1 wherein the shielding layer is tied to ground.

14. A method of fabricating a shielding layer for a transformer comprising the steps of:

depositing a material and then altering the material so the material has areas of high conductivity and areas of low conductivity; and placing the material between a first winding and a second winding of a transformer.

15. A combination of a Faraday shield and a device to be shielded against electromagnetic noise, comprising:

a Faraday shield of conductive material;

a device to be shielded against electromagnetic noise adjacent to the Faraday shield, wherein the Faraday shield includes areas of high conductivity and areas of low conductivity; and the areas of low conductivity are generally dispersed throughout the Faraday shield.

16. The combination according to claim 15 wherein the conductive material forms a lattice.

17. The combination according to claim 15 wherein the low conductivity areas in the Faraday shield are circular.

18. The combination according to claim 15 wherein the device is a planar transformer.

19. The combination according to claim 15 the device is on a circuit board.

20. The combination according to claim 15, wherein the low conductivity areas include an insulator or low conductivity material.

21. The combination according to claim 15 wherein the low conductivity areas in the Faraday shield are openings.

22. The combination according to claim 15 wherein the conductive material is a metal.

23. The combination according to claim 22 wherein the metal is copper.

* * * * *